US006832932B1

(12) United States Patent
Moseley

(10) Patent No.: US 6,832,932 B1
(45) Date of Patent: Dec. 21, 2004

(54) COAXIAL CABLE CONNECTOR HAVING ANTI-ROTATIONAL FEATURES

(75) Inventor: Andrew P. Moseley, Ogunquit, ME (US)

(73) Assignee: Tru Corporation, Peabody, MA (US)

( * ) Notice: Subject to any disclaimer, the term of this patent is extended or adjusted under 35 U.S.C. 154(b) by 0 days.

(21) Appl. No.: 10/606,990

(22) Filed: Jun. 26, 2003

(51) Int. Cl.[7] ..... H01R 9/05
(52) U.S. Cl. ..... 439/578; 439/869
(58) Field of Search ..... 439/578, 583, 439/584, 585, 869, 733.1

(56) References Cited

U.S. PATENT DOCUMENTS 5,453,025 A * 9/1995 Wilson ..... 439/578
5,489,222 A * 2/1996 Moyer et al. ..... 439/748
5,562,482 A * 10/1996 Wright ..... 439/429
5,944,556 A * 8/1999 Wlos et al. ..... 439/583

* cited by examiner

*Primary Examiner*—Tho D. Ta
(74) *Attorney, Agent, or Firm*—Grossman, Tucker, Perreault & Pfleger, PLLC

(57) ABSTRACT

An electrical connector including a center conductor assembly having an inner conductor, an insulator and center a contact for electrically coupling with a mating connector. The center contact includes at least one spur which engages with the insulator to resist rotation of the center contact relative to the insulator. The insulator may include an anti-rotational feature around the circumference thereof to resist rotational movement relative to a connector body.

21 Claims, 5 Drawing Sheets

COAXIAL CABLE CONNECTOR HAVING ANTI-ROTATIONAL FEATURES

FIELD OF THE INVENTION

The present invention relates in general to electrical connectors and, in particular, to a coaxial cable connector including anti-rotational features for resisting relative rotational movement between connector components.

BACKGROUND

Coaxial cable is widely used in various industries, and the construction of such cables is well known. Generally, a coaxial cable includes a center conductor for transmitting signals. The center conductor is surrounded by a dielectric insulator material, which is itself surrounded by a metallic outer conductor. The outer conductor is often a braided wire shielding. Conventionally, the outer braided shielding is also covered by an insulating jacket.

Coaxial transmission line cable is typically electrically and mechanically coupled to other cables or equipment using end connectors known for the purpose. While the exact arrangement of coaxial connectors varies to some degree, generally a connector may include a conductive metal body and a center conductor electrically isolated from the body. The cable may be stripped to expose the cable center conductor. The cable center conductor may then be soldered or crimped to a center conductor of the connector. Once the cable center conductor is soldered to the center conductor of the connector, the cable braid may be mechanically secured and/or electrically coupled to the connector body, such as by a shrink-wrap dielectric installed over the braid. The connector may also be mechanically secured to the connector by an end portion of the connector.

A coaxial cable having a connector end is often coupled to a mating connector using a coupling nut that engages a threaded portion of the mating connector. However, joining the connector components with a coupling nut often imparts rotational or twisting forces on the connectors and the internal components thereof. Such twisting of the connectors may cause the center conductor assembly of the connector to come loose. In such a loosened state, the center conductor may be susceptible to further twisting movement which may impair a proper connection between connector components.

Accordingly, it is an object of the present invention to provide an electrical connector for a coaxial cable that resists loosening of the conductors as a result of applied twisting forces.

SUMMARY OF THE INVENTION

According to one aspect, the present invention provides a center conductor assembly of an electrical connector for a transmission line cable. The center conductor assembly includes an insulator defining an opening therethrough, an inner conductor including a first end configured to be electrically coupled to a center conductor of a transmission line, and a center contact having a first end configured to mate with a mating center contact, and a second end configured to electrically contact the second end of the inner conductor. At least one spur is provided adjacent the second end of the center contact, and at least a portion of one of the inner conductor and the center contact are disposed through the opening defined in the insulator. The spur engages with the insulator, thereby resisting rotational movement of the center contact relative to the insulator.

According to another aspect, the present invention provides an electrical connector for a coaxial cable. The connector includes a body having a mating connector end configured to mate with a mating connector and a cable connection end having a cable opening therein for receiving at least a portion of the cable. A dielectric insulator is disposed in the body, a portion of the insulator defining a generally centrally located opening there through. The insulator includes an anti-rotational feature about at least a portion of a circumference of the insulator configured to engage the body to resist rotational movement of the insulator relative to the body. An inner conductor is disposed extending into the opening in the insulator, with a first end of the inner conductor being adjacent the cable receptacle end of the body. The first end of the inner conductor is configured to electrically couple with a center conductor of the coaxial cable. A second end of the inner conductor includes a post adjacent to the mating connector end. The connector further includes a center contact including a first end configured to contact a center contact of a mating connector and a second end including an opening dimensioned to receive the post of the inner conductor. At least one spur extends from the center contact adjacent the second end. The spur engages the insulator thereby resisting rotational movement of the center contact relative to the insulator.

According to another aspect, the present invention provides a method of making an electrical connector including: providing an insulator having an opening therein, providing an inner conductor having a first end configured to mate with a center conductor of a transmission line, and providing a center contact having a first end configured to mate with a mating center contact of a mating connector, a second end configured to be coupled with a second end of the inner conductor, and at least one spur extending from the center contact adjacent the second end. The method further includes inserting at least a portion of a second end of the inner conductor in the opening, and electrically contacting the second end of the center contact with the first end of the inner conductor with the at least one spur engaging the insulator for thereby resisting rotational movement of the center contact relative to the insulator.

BRIEF DESCRIPTION OF THE DRAWINGS

The advantages of the present invention are described with reference to particular exemplary embodiments thereof, which description should be understood in conjunction with the accompanying illustrations, wherein.

DETAILED DESCRIPTION

For simplicity and ease of explanation, the present invention will be described herein in connection with various exemplary embodiments thereof. Those skilled in the art will recognize that the features and advantages of the present invention may be implemented in a variety of configurations. It is to be understood, therefore, that the embodiments described herein are presented by way of illustration, not of limitation.

Figure 1:
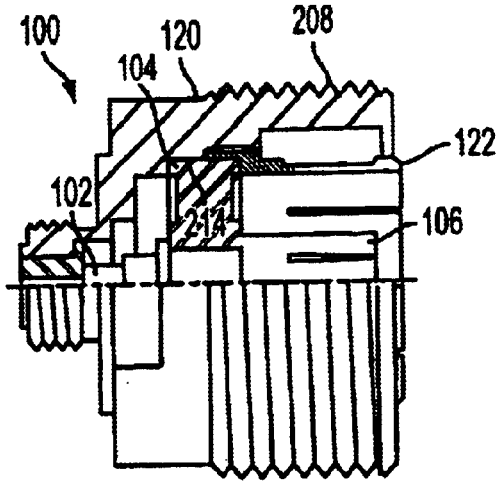
FIG. 1 is a side view of an exemplary connector consistent with the invention wherein a top half of the connector is illustrated in partial sectional view.

FIG. 1 illustrates an exemplary electrical connector 100 consistent with the invention. Those skilled in the art will recognize the illustrated connector is configured as a receptacle portion of a mating plug and receptacle coaxial connector assembly. It is to be understood, however, that the present invention may be provided in a variety of receptacle and/or plug coaxial connector types.

The illustrated exemplary connector 100 generally includes an outer shell 120, an outer conductor 122, and a center conductor assembly including an inner conductor 102, a dielectric insulator 104, and a receptacle center contact 106. As shown, the inner conductor 102 and the center contact 106 may be assembled though a generally centrally located aperture in the insulator 104 in a manner to provide a reliable electrical connection therebetween. The insulator 104 may be press fit into the outer shell 120, and the outer conductor 122 may be press fit between the insulator 104 and the outer shell 120.

Figure 2A:
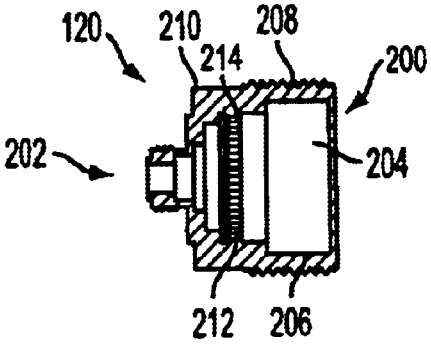
FIG. 2A is a side view of an exemplary outer shell consistent with the invention.
Figure 2B:
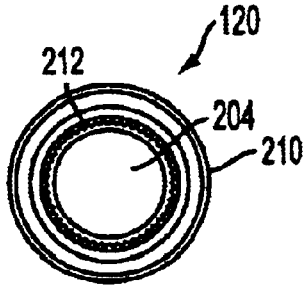
FIG. 2B is an end view of the exemplary outer shell illustrated in FIG. 2A.

FIGS. 2A and 2B illustrate an exemplary outer shell 120 useful in connection with the present invention. As shown, the outer shell 120 may be of generally tubular construction with a matting connector end 200 having a wider diameter than a cable connection end 202. A central opening 204 through the outer shell is defined by an interior surface 206 configured for receiving the outer conductor and center conductor elements, e.g. in a press fit.

Threads 208 may be provided on an exterior surface 210 of the mating connector end. The threads may be provided to facilitate a threaded connection with a mating connector (not shown), e.g. plug-type connector. The threaded connection establishes a reliable mechanical connection between the receptacle and plug portions with the center conductor of the plug connector electrically connected to the center contact 106 of the connector 100. Although the illustrated exemplary embodiment includes threads for making a threaded connection with a mating connector, it is to be understood that a connector consistent with the invention may be configured with a variety of cooperating mechanical means for securely coupling with a mating connector to ensure reliable electrical connection between the connector and the mating connector.

A portion of the interior surface 206 for contacting the insulator may include features, e.g. teeth 212, for engaging the exterior surface of the insulator 104. Engagement of the teeth 212 with the exterior surface of the insulator resists relative rotational movement between the outer shell 120 and the insulator 104, thereby minimizing detrimental effects on connector performance associated therewith. In one embodiment, 48 teeth may be disposed circumferentially around a shelf 214 defined by the interior surface 206. The shelf 214 may be positioned and dimensioned such that it extends across about half of the thickness of the insulator 104 when the insulator is press fit into engagement with the shelf 214, as shown in FIG. 1.

Figure 3:
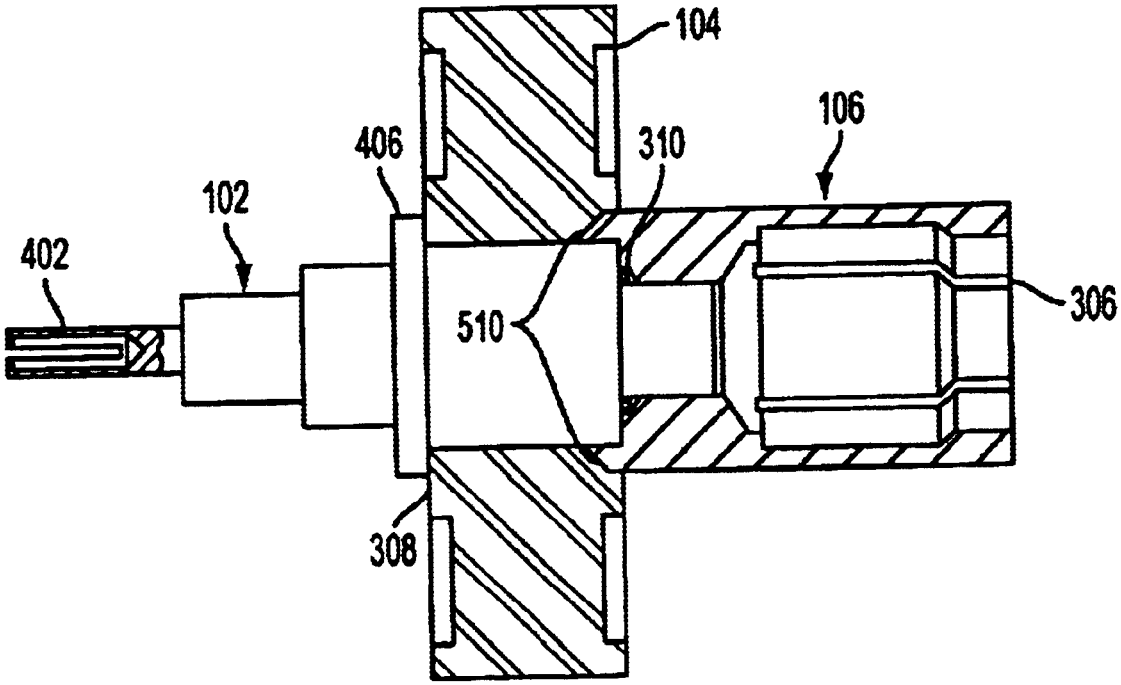
FIG. 3 is a side, partial sectional view of an exemplary center conductor assembly consistent with the invention.
Figure 4:
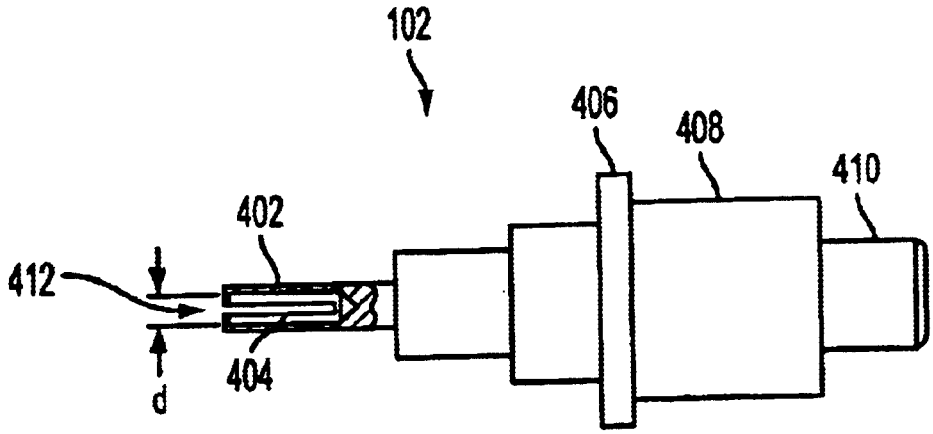
FIG. 4 is a partial cross-sectional view an exemplary inner conductor consistent with the invention.

FIG. 3 illustrates an exemplary center conductor assembly useful in a connector consistent with the invention. The inner conductor portion 102, which is separately illustrated in FIG. 4, generally includes portions defining receptacle pin 402 to facilitate coupling with a cable, a flange 406, body 408 and post 410. The receptacle pin 402 may include an opening 412 dimensioned for receiving a center conductor of a cable (not shown).

When the cable center conductor pin is disposed in the receptacle pin 402 an electrical connection is made between the inner conductor 102 and the cable center conductor. Advantageously, the electrical connection may be made simply by inserting the cable center conductor into the opening 412. Providing the receptacle pin 402 with an inner diameter d sized to provide at least a slight interference fit with the cable center conductor may facilitate electrical connection.

One or more axially extending slots 404 may be provided in the receptacle pin 402 to allow expansion of the inner diameter d when a cable center conductor is disposed therein. The combination of these features may provide sufficient mechanical and electrical coupling between the cable center conductor and the inner conductor 102. However, a more secure joint may be achieved by soldering, crimping, etc. the receptacle pin 402 to the cable center conductor.

The flange 406 and body portion 408 may aid in positioning the inner conductor 102 relative to the insulator 104. As illustrated in FIG.3, the body portion 408 may be press fit into the insulator 104, which includes a generally central opening therein for receiving the inner conductor 102. Axial placement of the inner conductor 102 relative to the insulator 104 may be determined by engagement of the flange 406 with a surface 308 of the insulator 104.

The body portion 408 of the inner conductor 102 may include mechanical engagement features for engaging the insulator 104. Engagement of the body 408 with the insulator may not only assist in fixing the position of the inner conductor 102 relative to the insulator 104 by resisting axial movement, but may also aid rotational positioning by resisting any twisting of the inner conductor 102 relative to the insulator 104. Exemplary mechanical features may include knurling, barbs, annular protrusions, etc.

In the illustrated embodiment, the inner conductor 102 may be coupled to the receptacle center contact 106 by way of post 410. Coupling of inner conductor post 410 with the receptacle center contact 106 provides both mechanical attachment between the components 102, 106 as well as electrical connection. The post 410 may be connected to the center receptacle contact 106 in a variety of manners.

FIGS. 5A–5D illustrate an exemplary center contact useful in a connector consistent with the invention. The center contact 106 may include an opening 508 dimensioned for receiving the post portion 410 of the inner conductor 102. The opening 508 may be sized to provide an interference or press fit, thereby providing secure mechanical and electrical connection between the inner conductor 102 and the center contact 106. As illustrated, the opening may include chamfers or rounds to facilitate assembly of the center contact 106 and the inner conductor.

In further embodiments, the post 410 may be soldered to the receptacle center contact 106. A solder joint, shown at 310 in FIG. 3, may be either continuous or intermittent about the circumference of the joint. It should be appreciated that numerous other mechanisms for attaching the inner conductor 102 and the center contact 106 may also be suitable, such as mating threads on the inner conductor 102 and the center contact 106, etc.

Figure 5A:
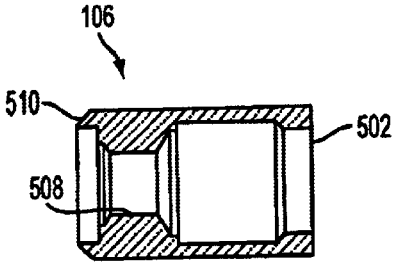
FIG. 5A is a cross sectional view of an exemplary center contact portion consistent with the invention.

As shown particularly in FIG. 5A, the receptacle center contact 106 may include a generally tubular body. A receptacle opening 502 in a first end of the receptacle center contact 106 is provided for receiving a mating plug center contact of a mating connector portion. Typically, the receptacle center contact 106 may rely on frictional engagement with a plug contact to provide sufficient electrical coupling. Accordingly, the receptacle opening 502 may have an inside diameter slightly smaller than a mating plug contact. The receptacle center contact 106 may include a plurality of radially spaced slots 506, shown particularly in FIGS. 5C and 5D to facilitate resilient expansion of the inside diameter 504 when the plug contact is inserted into the receptacle opening 502.

Figure 5B:
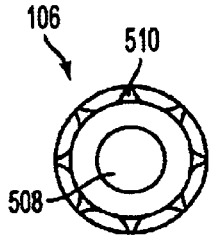
FIG. 5B is an end view of the center contact illustrated in FIG. 5A.
Figure 5C:
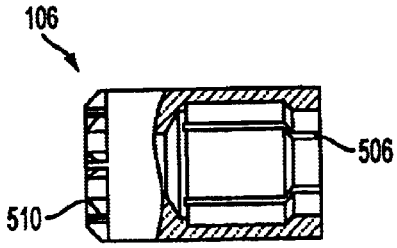
FIG. 5C is another cross sectional view of the center contact illustrated in FIG. 5A.
Figure 5D:
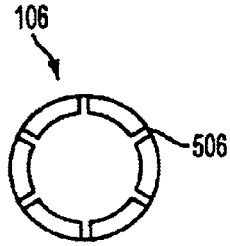
FIG. 5D is another end view of the center contact illustrated in FIG. 5A.

Advantageously, the center contact 106 may include a plurality of spurs 510. The spurs 510 may extend from the end of the center contact 106 adjacent to the opening 508, as shown in FIGS. 5B and 5D. When the center contact 106 is assembled to the insulator 104, the spurs 510 may engage the insulator 104 to resist rotation or twisting of the center contact 106 relative to the insulator 104. The spurs 510 may engage the insulator 104, for example, by penetrating into or digging into the insulator 104.

The spurs may be generally triangular in shape. As shown, the sides of the spurs may be arcuate, as may be formed by a series of intersecting circular cuts. It should be appreciated that various other geometries are suitable for the spurs 510, provided that the spurs 510 engage the insulator 104 and resist rotational movement of the center contact 106 relative to the insulator 104. For example the spurs 510 may be configured as radial fins or rectangular lugs that can be pressed into the insulator 104 to resist rotational movement of the center contact 106.

Figure 6:
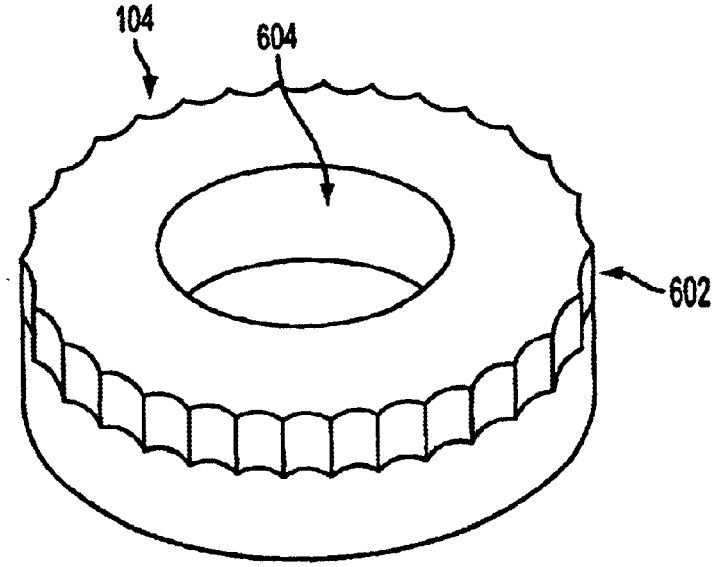
FIG. 6 is a perspective view of an exemplary insulator consistent with the present invention.

Turning now to FIG. 6, there is illustrated an exemplary insulator 104 for a center conductor assembly consistent with the invention. The insulator 104 may be provided to electrically insulate the center conductor assembly from the body of the connector, or other electrical pathway including the braided shielding of the coaxial cable. The insulator 104 may be formed from Teflon™, or other known insulating materials. As alluded to previously, the insulator 104 may generally be a disc or cylinder having a generally centrally located aperture 604 for receiving the inner conductor and/or center contact therethrough. The insulator may be press fit into a body component of the connector.

The insulator may incorporate anti-rotational features 602 around at least a portion of the circumference or thickness of the insulator 104. The anti-rotational features 602 advantageously increase the rotational resistance of the insulator 104 in the connector body. As shown in the exemplary embodiment, the anti-rotational feature 602 may extend along only a portion of the thickness of the insulator 104, relating to the amount of the insulator 104 that is retained by the body of the connector.

Consistent with the present invention, suitable anti-rotational features 602 may include scalloping or axially oriented grooves disposed in the circumferential surface of the insulator 104. As mentioned, Teflon™, as well as other fluoro- and/or ethylene based polymeric materials may be used for the insulator 104. Such materials typically have a high degree of lubricity, which may make it difficult to achieve a secure frictional or press fit. Providing surface detail may be, therefore, be especially advantageous for preventing rotation of the insulator.

There is thus provided a center conductor assembly for a coaxial connector. The assembly includes spurs on a center contact portion. The spurs engage an insulator portion for resisting rotational movement of the center contact relative to the insulator. The insulator may also include anti-rotational features that engage the connector body for resisting relative rotational movement between the insulator and the connector body. The center conductor assembly is thus less susceptible to damaging rotational forces applied thereto, e.g. through the process of coupling mating connectors to the connector body.

Figure 7:
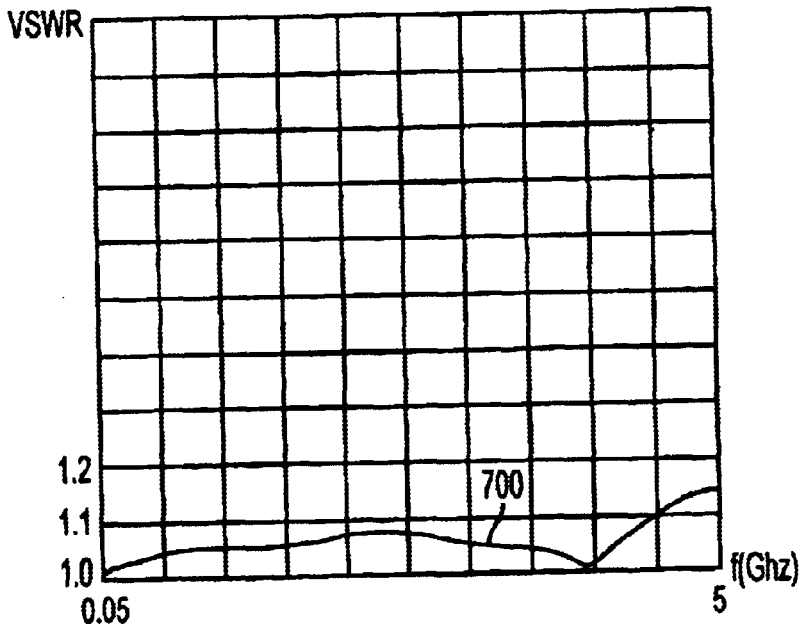
FIG. 7 is a plot of voltage standing wave ratio vs. frequency for an exemplary connector consistent with the invention.

Advantageously, these features are provided in an assembly the exhibits low voltage standing wave ratio (VSWR) over the operating frequency range of the connector. In addition, the assembly exhibits an insertion loss of less than 0.5 dB. FIG. 7 is a plot 700 of voltage standing wave ratio vs. frequency associated with one exemplary embodiment of a connector constructed as shown in FIG. 1. The plot spans a frequency range of 0.05 to 5 GHz. As shown, the exemplary connector exhibits a VSWR of less than 1.15, e.g. less than 1.1408 in plot 700, over the range from 0.05 GHz to 5 GHz. Another exemplary embodiment exhibits a VSWR of less than 1.25 over the range from 5 GHz to 7.5 GHz.

The embodiments that have been described herein, however, are but some of the several which utilize this invention and are set forth here by way of illustration but not of limitation. It is obvious that many other embodiments, which will be readily apparent to those skilled in the art, may be made without departing materially from the spirit and scope of the invention as defined in the appended claims.

What is claimed is:

1. A center conductor assembly comprising;

an insulator including portions defining an opening extending axially therethrough;

an inner conductor comprising a first end configured to be electrically coupled to a center conductor of a transmission line, at least a portion of said inner conductor being disposed in said opening; and a center contact having a first end configured to mate with a mating center contact, and a second end for electrically connecting with a second end of said inner conductor, and a least one spur extending axially from an end surface at said second end of said center contact, said at least one spur engaging said insulator thereby resisting rotational movement of said center contact relative to said insulator.

2. The center conductor assembly according to claim 1 wherein said insulator comprises anti-rotational feature around at least a portion of a circumference of said insulator.

3. The center conductor assembly according to claim 1 wherein said at least one spur comprises a generally triangular projection.

4. The center conductor assembly according to claim 1 comprising a plurality of said spurs.

5. The center conductor assembly according to claim 1 wherein said first end of said inner conductor comprises a receptacle dimensioned to receive a center conductor of said transmission line.

6. The center conductor assembly according to claim 1 wherein said first end of said center contact comprises one of a plug and a receptacle.

7. The center conductor assembly according to claim 1 wherein said second end of said center contact comprises an opening dimensioned to receive at least a portion of the second end of said inner conductor.

8. An electrical connector for a coaxial cable, said connector comprising:

a body including a mating connector end configured to mate with a mating connector and a cable connection end having a cable opening therein for receiving at least a portion of said cable;

an insulator disposed in said body, said insulator defining a generally centrally located opening therethrough, and said insulator comprising an anti-rotational feature about at least a portion of a circumference of said insulator configured to engage said body to resist rotational movement of the insulator relative to the body;

an inner conductor extending at least partially into said opening, a first end of said inner conductor being adjacent said cable connection end of said body and being configured to electrically couple with a center conductor of the coaxial cable, and a second end including a post adjacent to said mating connector end; and a center contact including a first end configured to contact a center contact of a mating connector, a second end including an opening dimensioned to receive said post of said inner conductor, and at least one spur projecting adjacent said second end, said spur engaging said insulator thereby resisting rotational movement of said center contact relative to said insulator.

9. The electrical connector according to claim 8 wherein said first end of said inner conductor comprises a receptacle configured to receive at least a portion of the center conductor of the coaxial cable.

10. The electrical connector according to claim 8 wherein said first end of said center contact comprises one of a receptacle and a plug.

11. The electrical connector according to claim 8, wherein said connector exhibits a voltage standing wave ratio of less than 1.25 over at least a portion of the operating frequency range of said connector.

12. The electrical connector according to claim 8, wherein said connector exhibits a voltage standing wave ratio of less than 1.15 over a frequency range from 0.5 GHz to 5 GHz.

13. The electrical connector according to claim 8, wherein said connector exhibits a voltage standing wave ratio of less than 1.25 over a frequency range from 5 GHz to 7.5 GHz.

14. A method of making an electrical connector comprising:

providing an insulator having an opening extending axially therein;

providing an inner conductor having a first end configured to mate with a center conductor of a transmission line;

providing a center contact having a first end configured to mate with a mating center contact of a mating connector, a second end configured to electrically contact a second end of said inner conductor, and at least one spur extending axially from an end surface of said center contact at said second end;

inserting at least a portion of a second end of said inner conductor in said opening; and electrically connecting said second end of said center contact with said second end of said inner conductor with said at least one spur engaging said insulator for thereby resisting rotational movement of said center contact relative to said insulator.

15. The method according to claim 14 wherein electrically connecting said second end of said center contact with said second end of said inner conductor comprises inserting a post portion of said second end of said inner conductor into an opening in said second end of said center contact.

16. The method according to claim 14 wherein said center contact comprises a plurality of said spurs.

17. The method according to claim 14 wherein said first end of said center contact comprises one of a plug and a receptacle configured to mate with a center contact of a mating connector.

18. The method according to claim 14 wherein said first end of said inner conductor comprises a receptacle configured to receive at least a portion of said center conductor of said transmission line.

19. The method according to claim 14 wherein electrically connecting said second end of said center contact with said second end of said inner conductor comprises soldering.

20. The method according to claim 14 further comprising inserting said insulator in a connector body configured to mate with a mating connector.

21. The method according to claim 20 wherein said insulator comprises an anti-rotational surface about at least a portion of a circumference thereof to resist rotational movement relative to said connector body.

* * * * *